US006976743B1

(12) United States Patent
Hwang

(10) Patent No.: US 6,976,743 B1
(45) Date of Patent: Dec. 20, 2005

(54) READY-TO-ASSEMBLE ENTERTAINMENT CENTER HAVING POCKET DOORS

(75) Inventor: Richard Hwang, Shenzhen (CN)

(73) Assignee: Orleans Furniture, Inc., Columbia, MS (US)

( * ) Notice: Subject to any disclaimer, the term of this patent is extended or adjusted under 35 U.S.C. 154(b) by 91 days.

(21) Appl. No.: 10/266,172

(22) Filed: Oct. 7, 2002

(51) Int. Cl.[7] ..... A47B 43/00
(52) U.S. Cl. ..... 312/258; 312/322
(58) Field of Search ..... 312/7.2, 139.1, 312/109, 258, 260, 324, 322, 323, 139.2, 312/326–329, 297, 307, 350; 16/368, 369; 52/70, 71; 160/199, 206

(56) References Cited

U.S. PATENT DOCUMENTS

| | | | | | |
|---|---|---|---|---|---|
| 827,292 | A | * | 7/1906 | Burtch | 49/257 |
| 962,228 | A | * | 6/1910 | Kuersten | 312/139.1 |
| 1,025,350 | A | * | 5/1912 | Welch | 312/139.1 |
| 1,256,144 | A | * | 2/1918 | Lewis | 16/368 |
| 2,351,656 | A | * | 6/1944 | Auten | 160/199 |
| 2,649,350 | A | * | 8/1953 | Backus et al. | 312/258 |
| 2,936,206 | A | * | 5/1960 | Wilmer et al. | 312/322 |
| 3,752,552 | A | * | 8/1973 | MacDonald | 312/258 |
| 3,907,021 | A | * | 9/1975 | Smith | 160/118 |
| 3,973,616 | A | * | 8/1976 | Jensen | 160/199 |
| 4,279,454 | A | * | 7/1981 | Koiso et al. | 312/297 |
| 4,852,212 | A | * | 8/1989 | Amann | 16/102 |
| 4,945,972 | A | * | 8/1990 | Takeuchi | 160/203 |
| 4,976,502 | A | * | 12/1990 | Kelley et al. | 312/322 |
| 5,108,165 | A | * | 4/1992 | Rorke et al. | 312/322 |
| 5,997,113 | A | * | 12/1999 | Benson | 312/195 |
| 6,253,393 | B1 | * | 7/2001 | Dries et al. | 4/607 |
| 6,296,038 | B1 | * | 10/2001 | Chen | 160/199 |
| 6,527,352 | B2 | * | 3/2003 | Lombardo | 312/322 |
| 6,848,758 | B1 | * | 2/2005 | Yeh et al. | 312/258 |
| 2003/0183350 | A1 | * | 10/2003 | Goldsmith et al. | 160/199 |

FOREIGN PATENT DOCUMENTS

| | | | | |
|---|---|---|---|---|
| IT | 526698 | * | 6/1957 | 312/257.1 |

* cited by examiner

*Primary Examiner*—Janet M. Wilkens
(74) *Attorney, Agent, or Firm*—MacCord Mason PLLC

(57) ABSTRACT

A ready-to-assemble casegood cabinet having pocket doors. A pocket door assembly for a ready-to-assemble casegood cabinet is also disclosed. A method of shipping a ready-to-assemble casegood cabinet, a method for assembling a ready-to-assemble casegood cabinet, and method of including a pocket door assembly in a ready-to-assemble casegood cabinet is disclosed.

8 Claims, 10 Drawing Sheets

READY-TO-ASSEMBLE ENTERTAINMENT CENTER HAVING POCKET DOORS

BACKGROUND OF THE INVENTION

The present invention relates generally to ready-to-assemble furniture and pocket doors therefor.

Traditionally, large residential furniture units such as entertainment centers have been manufactured and assembled at a manufacturing facility and shippped to a point of retail sale to a consumer. Such units are designed and manufactured to be shipped and sold as an assembled unit. This kind of design and manufacture of furniture is effective when the furniture sells in relative proximity to its place of manufacture because shipping costs are relatively low. The competitive marketplace, along with shifting labor market realities, however, has spurred the design and manufacture of furniture outside the U.S. intended for sale in the vast U.S. market.

Because in many cases furniture manufacturing can be accomplished at much lower costs far from the marketplace, ready-to assemble furniture has become increasingly popular of late. Ready-to-assemble furniture is that which is designed to be manufactured and shipped to a point of retail in unassembled form for assembly by retailers or consumers. Bookshelves, tables, beds and entertainment centers are especially viable pieces for the ready-to-assemble marketplace because such pieces have traditionally been constructed from relatively planar components that lend themselves readily to economic packaging and shipping. Manufacturers may encounter problems, however, incorporating basic features into ready-to-assemble furniture because such features may be difficult to package and ship cost-effectively or difficult to assemble by retailers and consumers.

One of the basic features widely available in furniture products that are difficult to include in ready-to-assemble furniture are pocket doors, which are doors—usually on the front of a case—that are selectively retractable into the case. Such doors are popularly used in entertainment centers in front of an area intended for a television.

Thus, there remains a need for a new and improved furniture unit that includes features such as pocket doors, while at the same time, is cost-effective to ship great distances, and is easily assembled by a consumer or retailer.

SUMMARY OF THE INVENTION

The present invention meets one or more of these needs by providing a ready-to-assemble casegood cabinet, which may be an entertainment center, including a front frame, an end panel pivotably affixed to the front frame, and a door that is selectively retractable into the cabinet during use. The end panel pivots into substantially parallel relation to the front frame to reduce the volume of the cabinet for shipping and storage, and pivots into a substantially perpendicular relation to the front frame for display and use. The front frame of the cabinet may be substantially planar and the axis about which the end panel pivots is rearward the plane of the front frame and may also include a shelf having a groove that is adjacent and parallel to the end panel when the cabinet is assembled.

A door assembly for a ready-to-assemble casegood includes a door support rail, a door hinge rail, and a hinge pivotably connecting the door support rail to the door hinge rail wherein the door assembly folds into the interior of the casegood for shipping and storing the casegood. The door hinge rail may include a tenon to prevent the hinge from opening during use of the cabinet.

The door assembly may further include a door track for moving the door to inside the casegood, a roller attached to the door support rail for moving the door support rail along the door track and a door pivotably affixed to the door hinge rail. The hinge may be a piano hinge.

A ready-to-assemble casegood cabinet, which may be an entertainment center, includes a door assembly which itself includes a door, a door support rail, a door hinge rail and a hinge, which may be a piano hinge, pivotably connecting the door support rail to the door hinge rail. The door assembly folds into the interior of the cabinet for shipping and storing the cabinet. The cabinet may include a shelf having a groove that is adjacent and parallel to the end panel when the cabinet is assembled. The door hinge rail may include a tenon for preventing the hinge from opening during use of the cabinet. The door assembly may include a door track and a roller attached to the door support rail for moving the door support rail along the door track.

DESCRIPTION OF THE PREFERRED EMBODIMENTS

Figure 1:
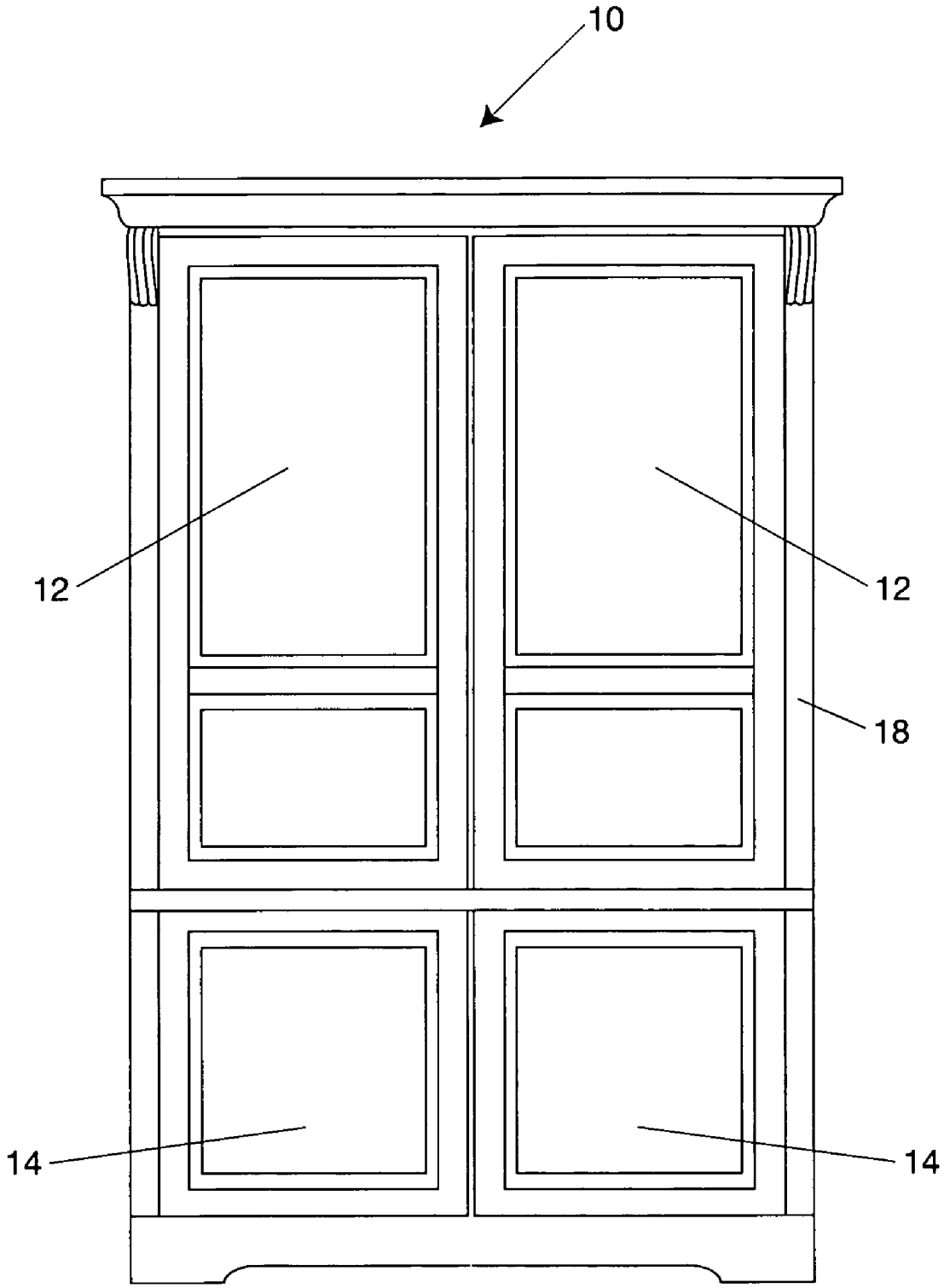
FIG. 1 is a front view of a ready-to-assemble casegood showing the casegood after assembly.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms. Referring now to the drawings, it will be understood that the illustrations are for the purpose of describing a preferred embodiment of the invention and are not intended to limit the invention thereto.

As best seen in FIG. 1, an entertainment center is shown constructed according to the present invention. The center 10 includes a front frame 18 that further includes doors 14 at the bottom of the entertainment center. Two substantially mirror image pocket doors 12 mount above the doors 14. While the preferred embodiment is shown as an entertainment center, the present invention also comprises embodiments such as bookcases and other cabinets, or other pieces in which a pocket door may be useful.

Figure 2:
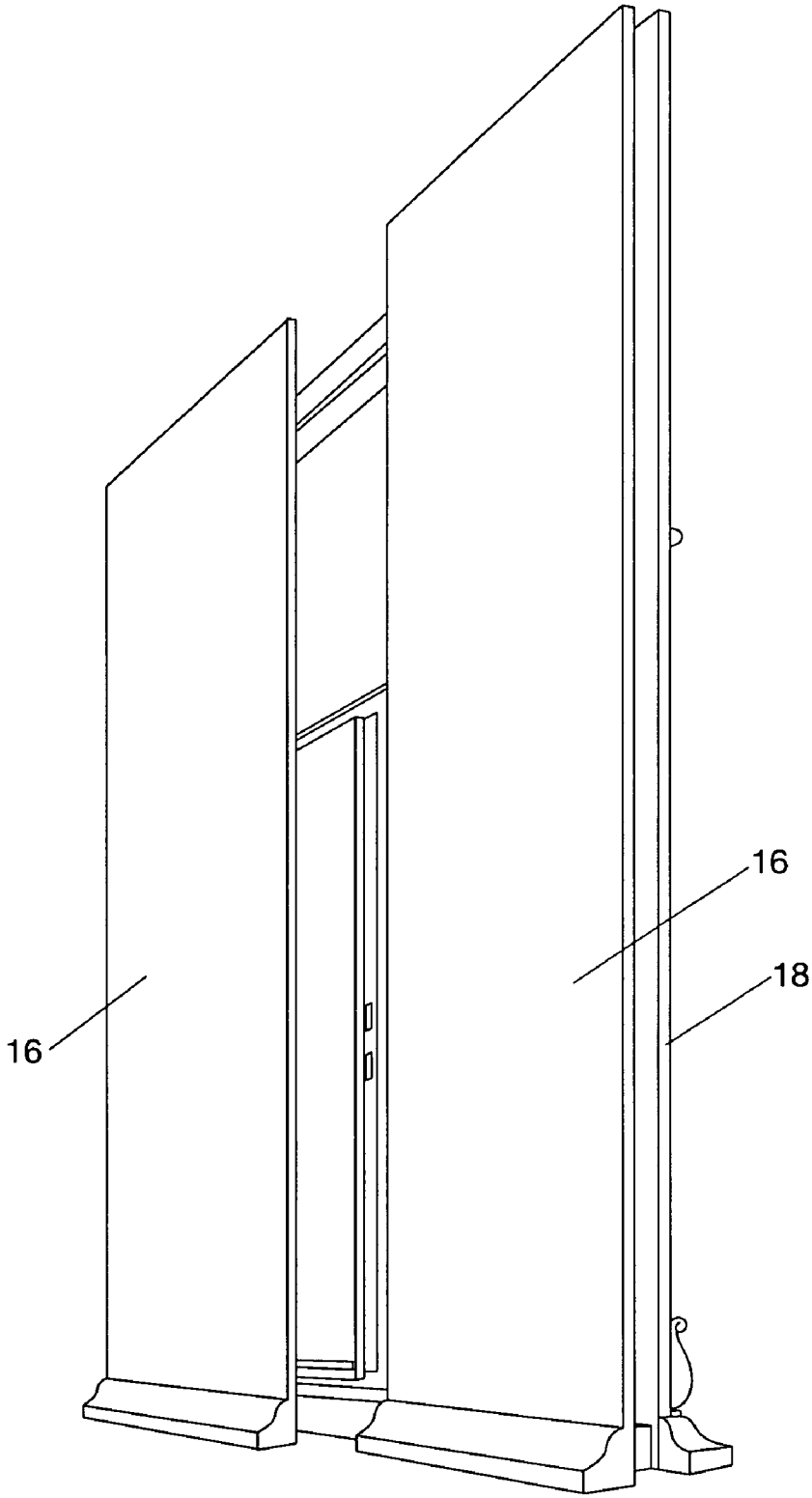
FIG. 2 is a perspective view of a ready-to assemble casegood before packaging and shipping.

FIG. 2 is a perspective view of a ready-to-assemble casegood configured for shipping. The casegood is an entertainment center that includes two end panels 16 and a front frame 18, which is substantially planar. The end panels 16 are in substantially parallel relation to the front frame 18 to reduce the volume of the entertainment center for packaging and shipping or storing. Such a relationship of the end panels 16 and front frame provides a space between the end panels 16 and the front frame 18 for storing components such as shelving and support rails, while at the same time, prevents damage that may occur to the entertainment center during shipping because the panels form nearly a box shape during shipping.

Figure 3:
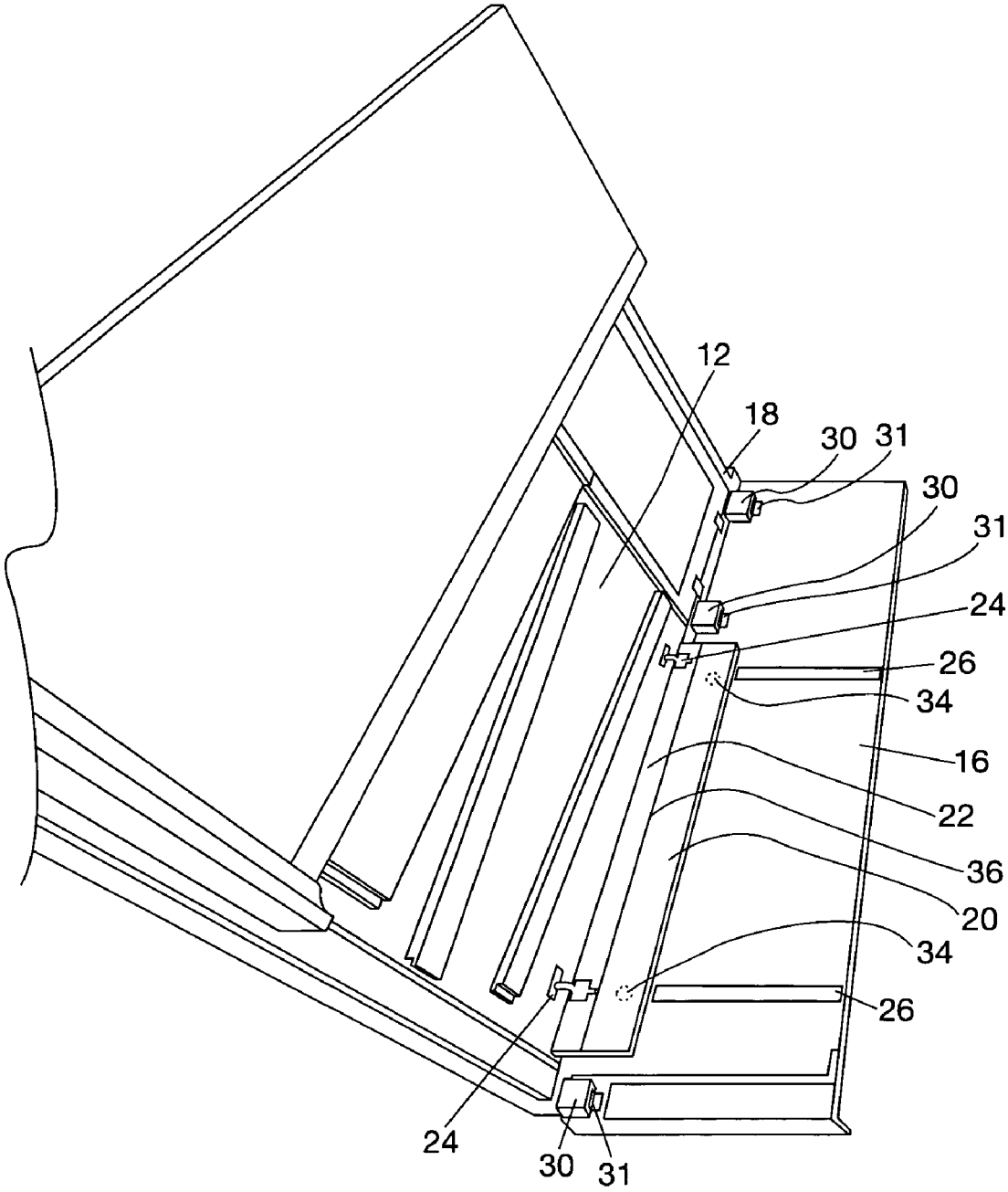
FIG. 3 is a perspective view of a ready-to-assemble casegood showing an end panel pivoted perpendicular to the front frame.
Figure 4:
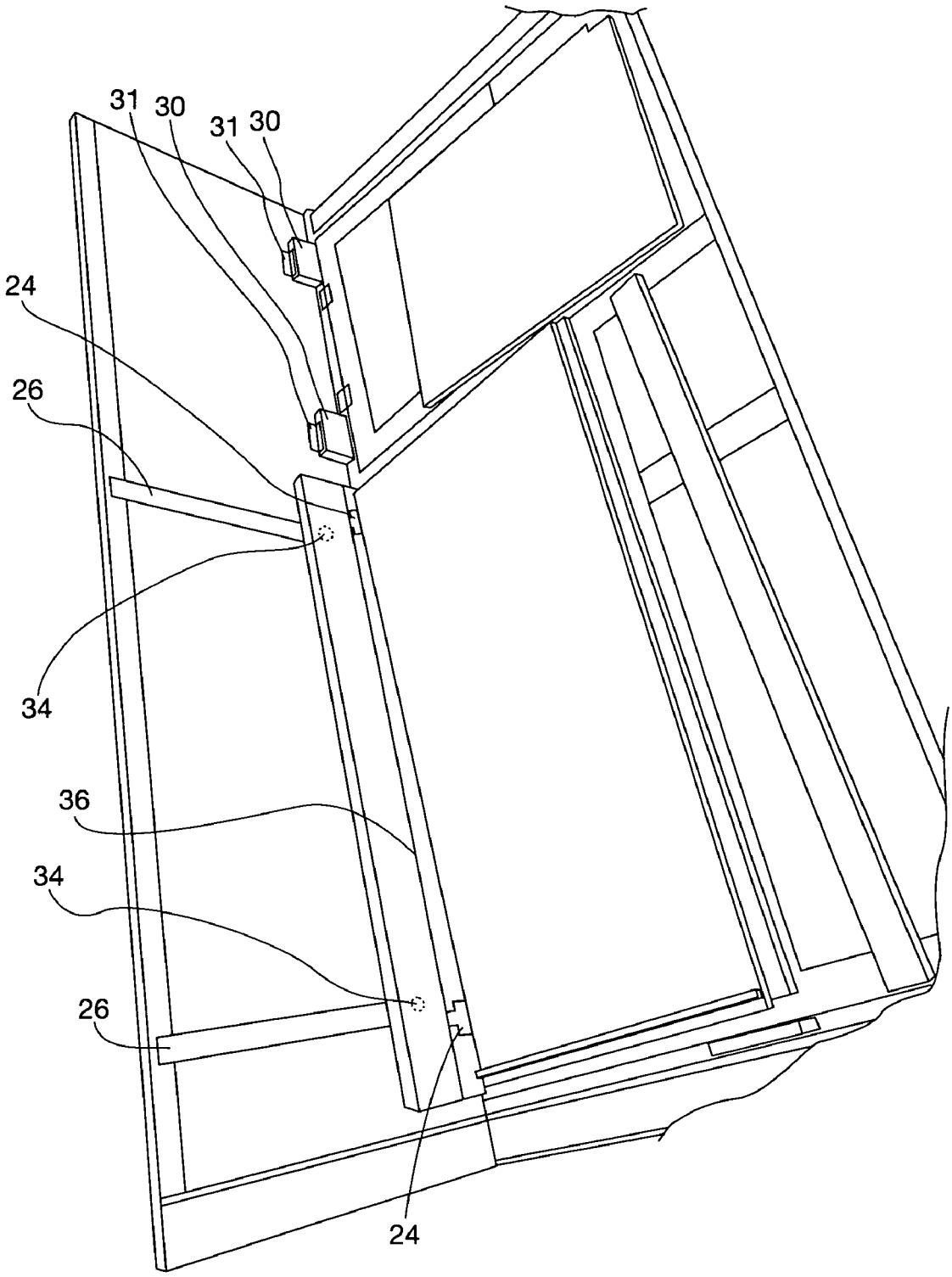
FIG. 4 is a perspective view of a ready-to-assemble casegood showing the opposite end panel pivoted perpendicular to the front frame.

FIG. 3 is a perspective view of a ready-to-assemble casegood during assembly showing an end panel 16, pivoted perpendicular about three hinges 31 attached to three corresponding hinge blocks 30 secured to the front frame 18. The hinge blocks 30 place the folding axis between the end panel 16 and front frame 18 rearward the plane of the front frame 18, or towards the back of the entertainment center. An interior volume is provided between the front frame and the panels 16, enabling storage of shelves and other assembly components during packaging and shipping or storing. The center also includes two substantially mirror image pocket doors 12, although the present invention can be constructed as a casegood having any number of doors. FIG. 3 shows the back of a pocket door 12 from the open back of the entertainment center. The pocket doors 12 include hinges 24 for opening the doors 12 of the entertainment center for viewing an object inside the center such as a television, for example. The door 12 is connected to the hinge rail 22 by hinges 24, and the hinge rail 22 is hinged to the door support rail 20 with a piano hinge 36, although many other types of hinges known in the art will work suitably. The hinges 24 allow the doors 12 to pivot until they are substantially in the same plane as the door support rails 20 and door hinge rails 22. Only after the pocket doors 12 are pivoted about the door hinges 24 can they be moved along the door track 26 on rollers 34 (hidden behind the door support rail 20 in FIG. 3) that are attached to the door suppport rail 20. Other suitable mechanisms for retracting the doors 12 include but are not limited to a sliding rather than rolling device. Additionally, the door track 26 can be fitted with a spring or other tensioner to bias the doors 12 to the retracted position. The piano hinge 36 joint allows the pocket doors 12 to fold into the interior section of the entertainment center between the end panels 16 when the end panels 16 are pivoted about the hinges 31 for shipping or storing the entertainment center. The piano hinges 36 connect the door support rail 20 to the door hinge rail 22 for retracting the pocket doors after assembly. While only one side of the entertainment center is shown in FIG. 3, the opposite side of the center is substantially the same, as can be seen in FIG. 4.

Figure 5:
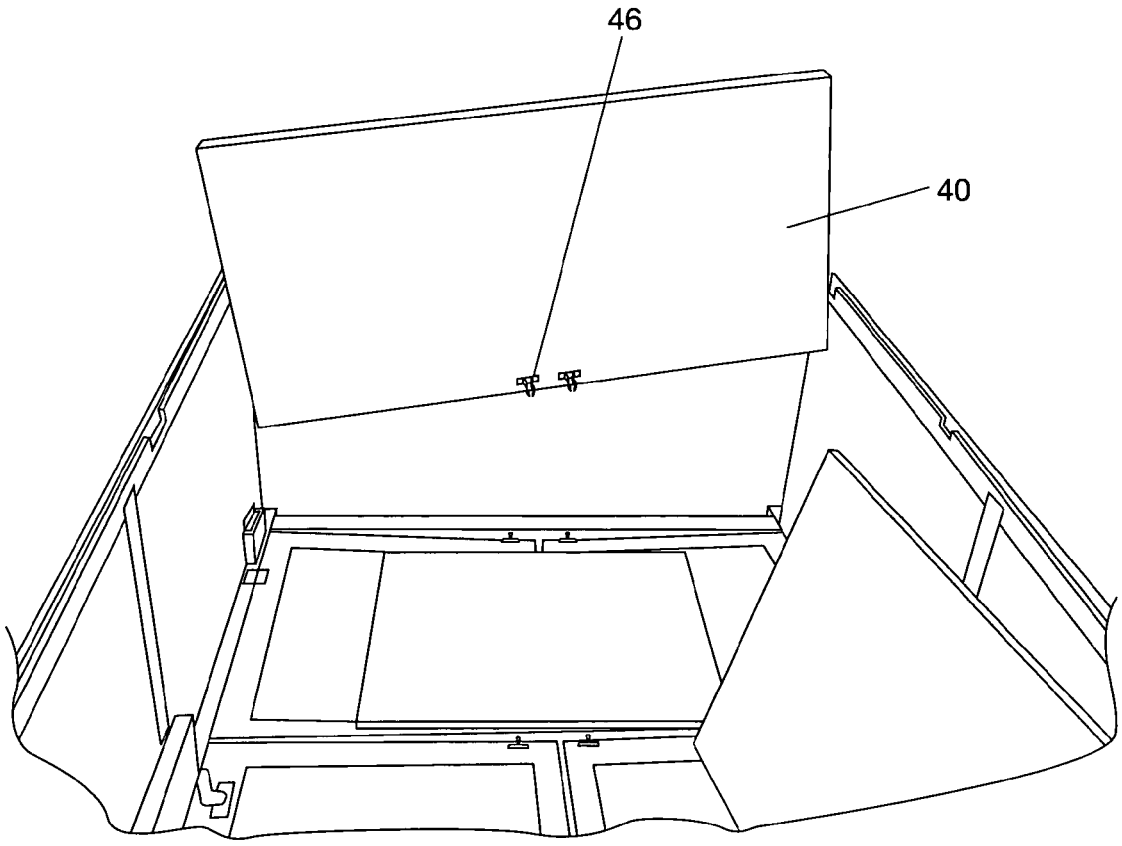
FIG. 5 is a view of a ready-to-assemble casegood showing assembly of a bottom panel.
Figure 6:
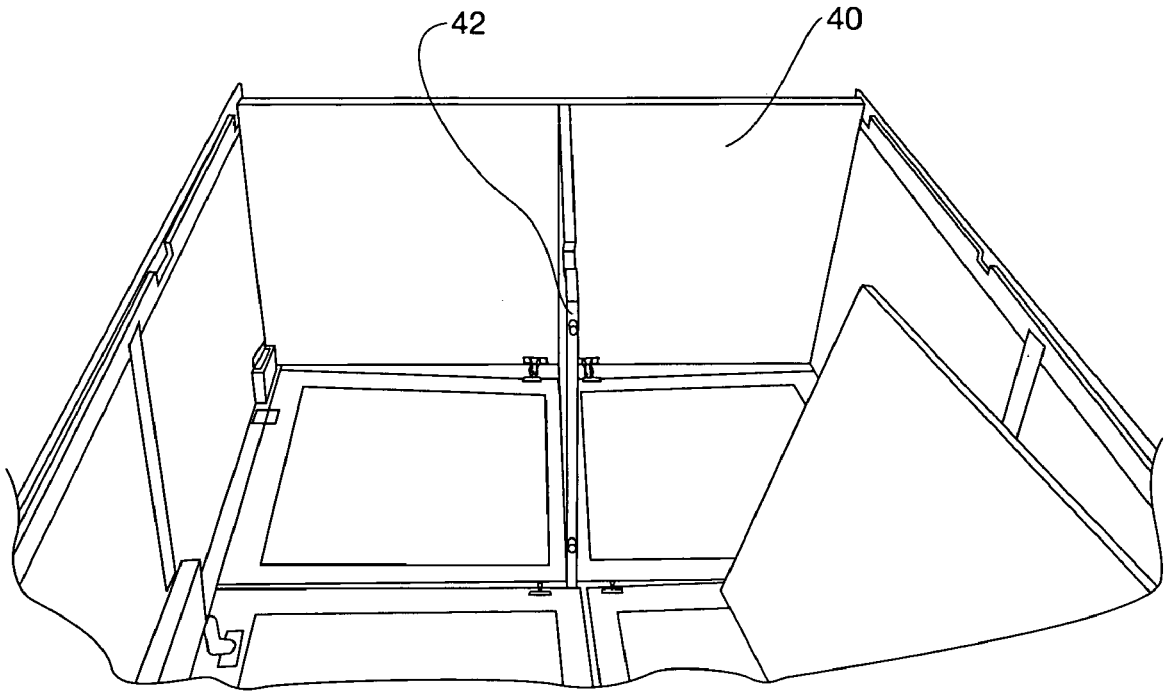
FIG. 6 is a view of a ready-to-assemble casegood showing the assembly of an upright divider.

FIG. 5 is a view of a ready-to-assemble casegood showing assembly of the bottom panel 40, which is a planar panel having a rectangular shape. The bottom panel of the entertainment center provides an area for storing items accessible through the doors 14 on the front frame 18 of the center. The bottom panel 40, which may include door latches 46, supports the assembled structure of the entertainment center because the end panels 16 cannot pivot inward about the hinge blocks 30 when the bottom panel 40 is inserted into the center during assembly. The television shelf 44 (shown in FIG. 10) and upright divider 42 along with a top panel (not shown) form the basic interior components of the entertainment center. The upright divider 42 is shown being assembled into the entertainment center on the bottom panel 40 in FIG. 6.

Figure 7:
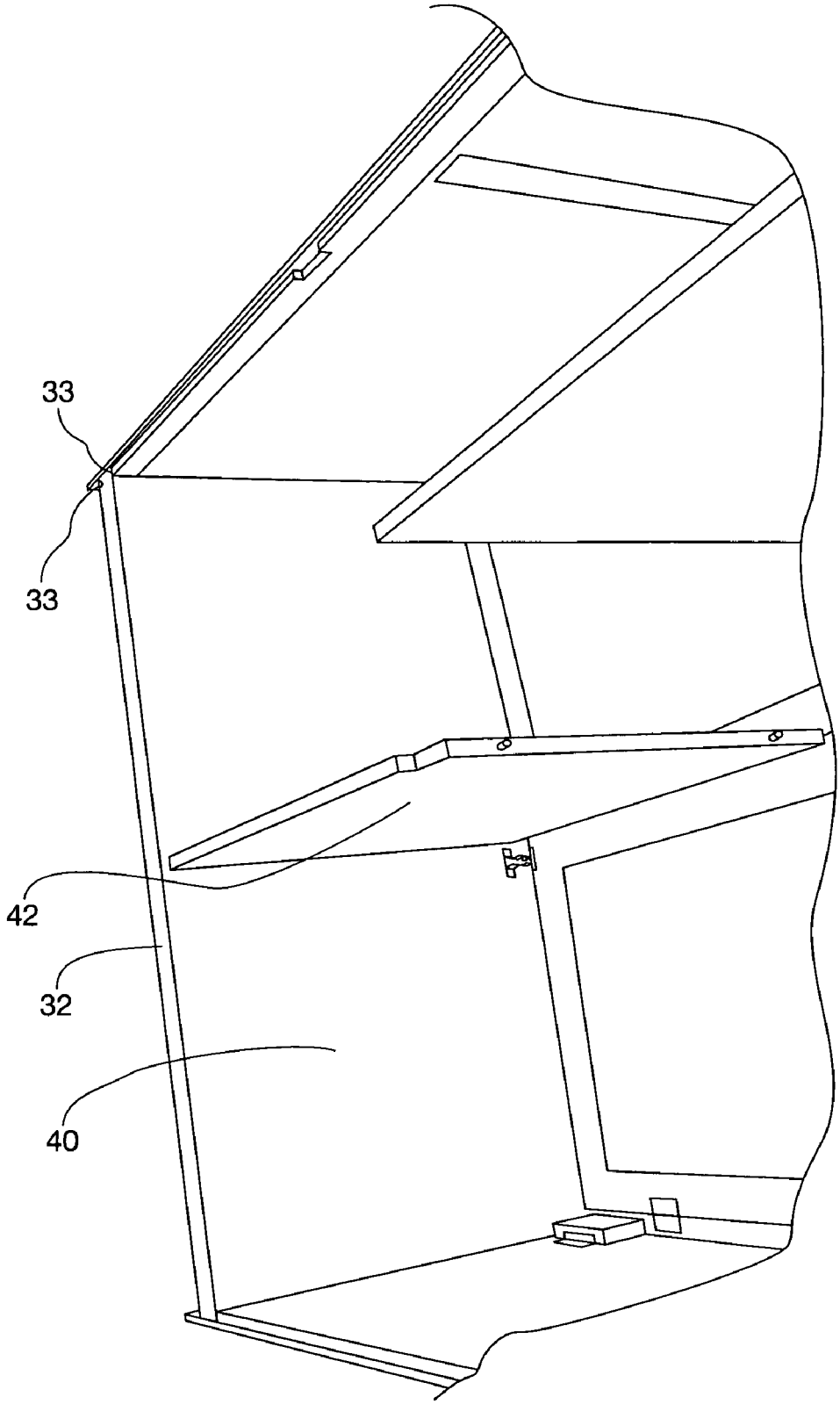
FIG. 7 is a view of a ready-to-assemble casegood showing the assembly of a cross rail brace.
Figure 8:
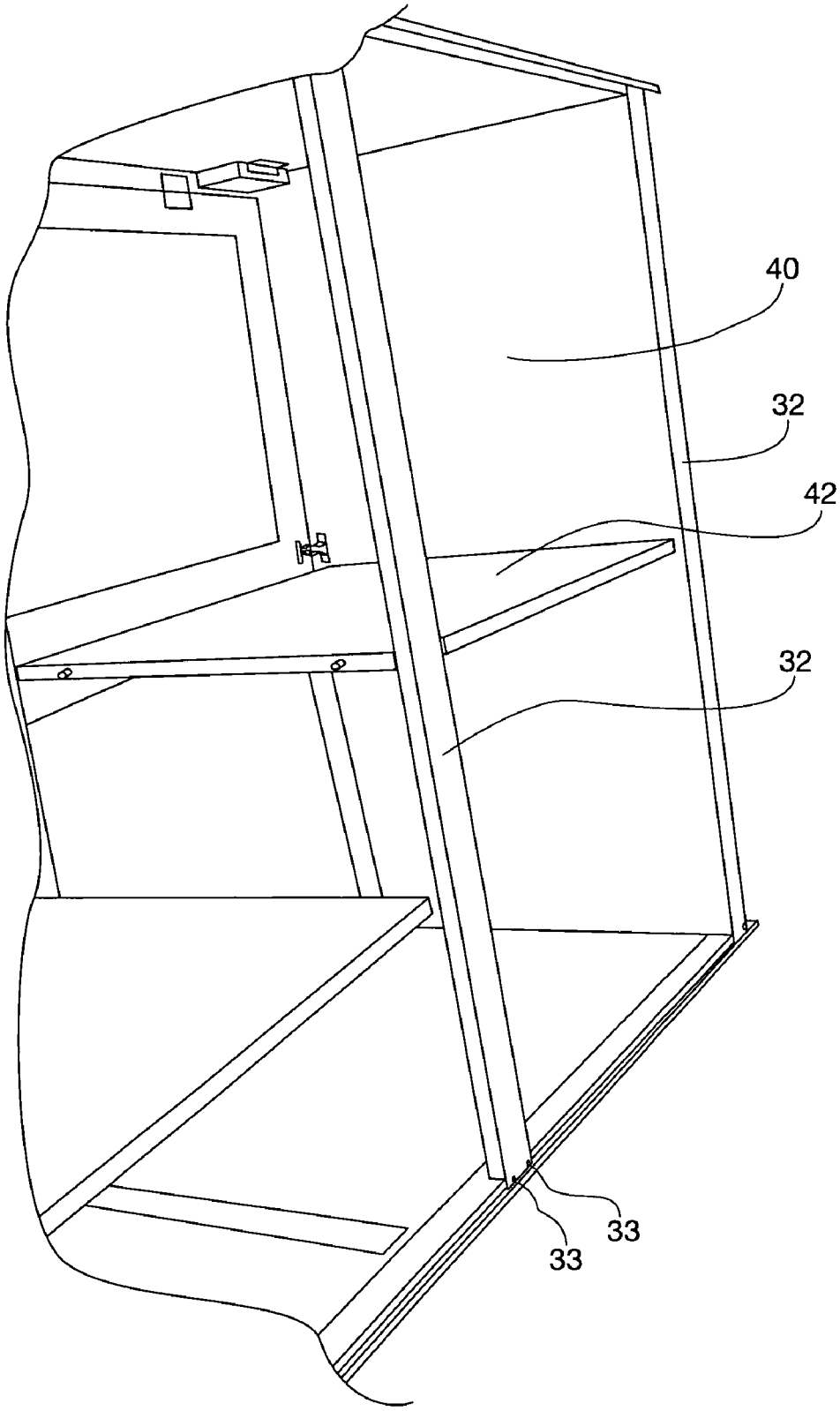
FIG. 8 is a view of a ready-to-assemble casegood showing the assembly an additional cross rail brace.

FIG. 7 shows the assembly of a lower cross rail brace 32. The cross rail braces 32 add structural integrity to the entertainment center after assembly. The ends of the cross rail brace 32 are secured into notches at the back of the side panels 16 by fasteners 33. Another cross rail brace is secured at the top of the upright divider 42 and fits into the notch therein, as shown in FIG. 8.

Figure 9:
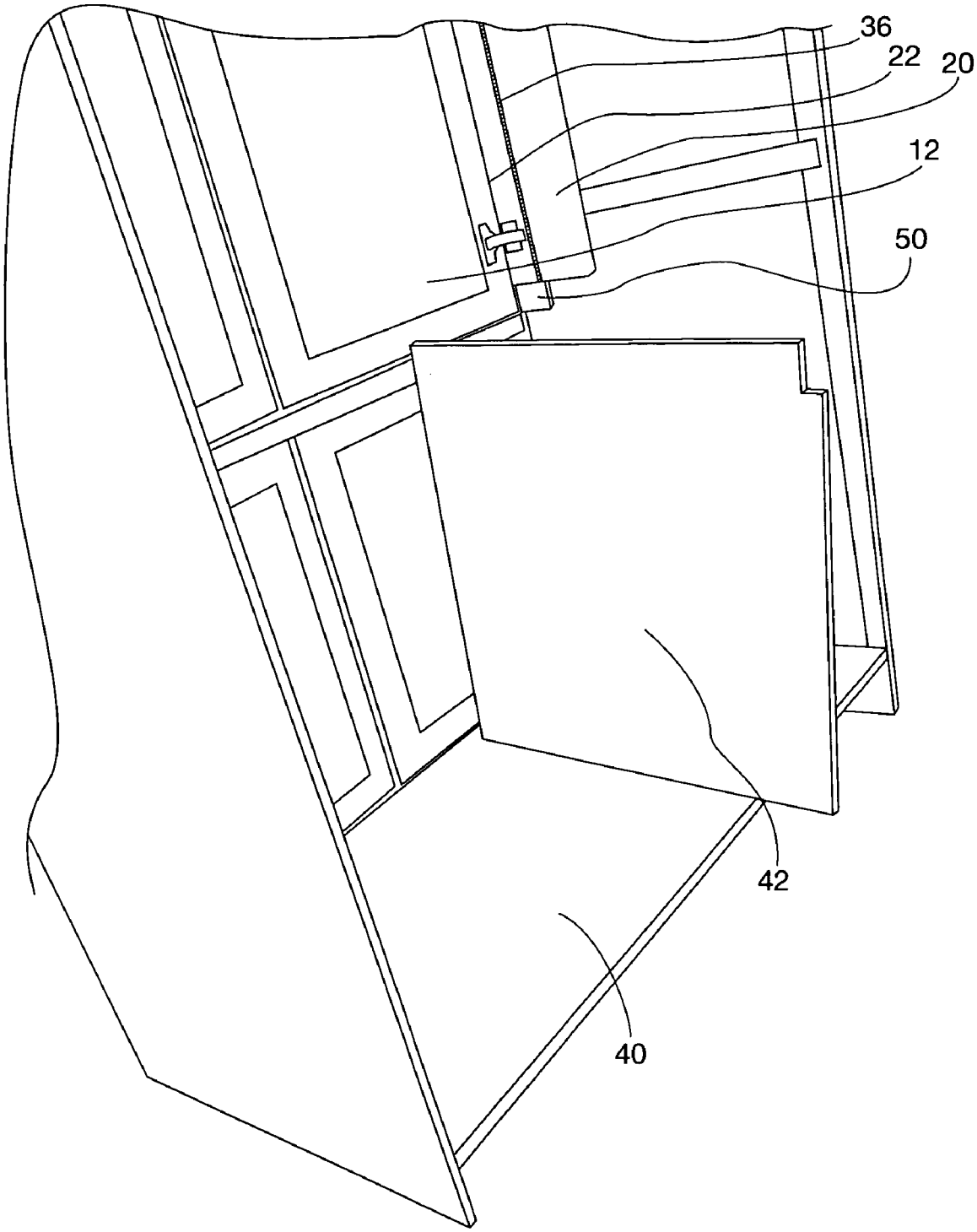
FIG. 9 is a perspective view from the back of a ready-to-assemble casegood.

FIG. 9 is a rear perspective view from the rear of a ready-to-assemble casegood showing the door hinge rail 22 and the door support rail 20. The door hinge rail 22 includes a tenon 50 extending downwardly beyond the lowest end of the door support rail. 20. The tenon moves along a groove on the television shelf when the door is selectively retracted into the entertainment center.

Figure 10:
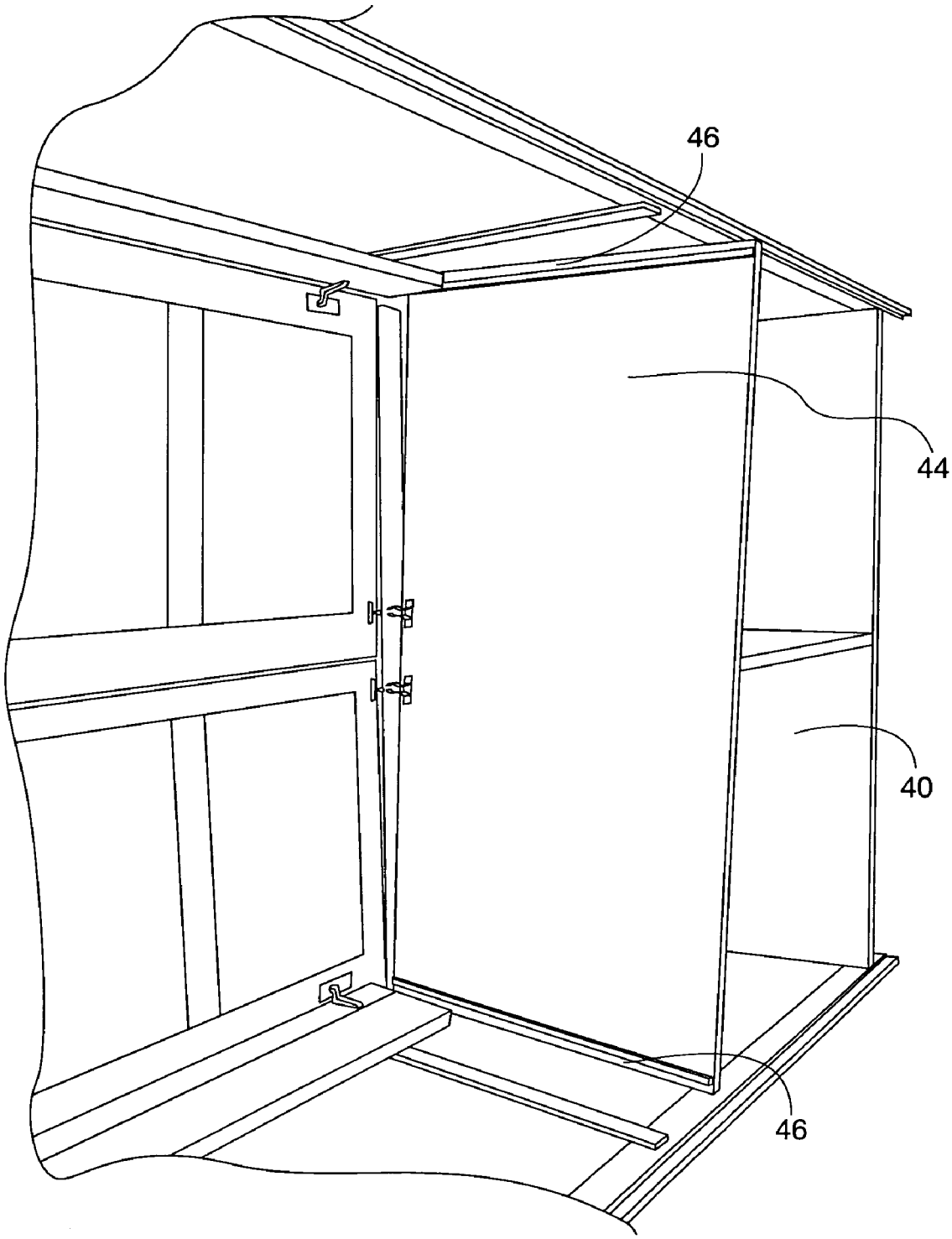
FIG. 10 is a view of a ready-to-assemble casegood showing a television shelf having a groove on two sides.

FIG. 10 is a view from above a ready-to-assemble casegood showing a television shelf 44 having a bar wity a groove 46 on opposite sides. The groove 46 provides a passage for the tenon 50 on the lower end of the door hinge rail 22. The tenons 50 and grooves 46 combine to keep the door hinge rail from pivoting along the piano hinge 36 during use of the entertainment center.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A ready-to-assemble casegood cabinet comprising:

a cabinet housing having foldable end panels;

a door assembly including:

a door;

a door support rail;

a door hinge rail; and a hinge pivotably connecting the door support rail to the door hinge rail;

wherein the door support rail folds along with the foldable end panels of the cabinet housing for shipping and storing the cabinet.

2. The cabinet according to claim 1 further comprising a shelf having a groove that is adjacent to at least one of the end panels when the cabinet is assembled.

3. The cabinet according to claim 2 wherein the groove is parallel to the end panel when the cabinet is assembled.

4. The cabinet according to claim 1 wherein the cabinet is an entertainment center.

5. The cabinet according to claim 1 wherein the door binge rail includes a tenon for preventing the hinge from opening during use of the cabinet.

6. The cabinet according to claim 1 wherein the door assembly further includes a door track for moving the door to inside the casegood.

7. The cabinet according to claim 6 wherein the door assembly further comprises a roller attached to the door support rail for moving the door support rail along the door track.

8. The cabinet according to claim 1 wherein the hinge is a piano hinge.

* * * * *